US006227183B1

(12) United States Patent
Miyoshi et al.

(10) Patent No.: US 6,227,183 B1
(45) Date of Patent: May 8, 2001

(54) MOUNTING DEVICE FOR EXHAUST GAS RE-CIRCULATION VALVE

(75) Inventors: Sotsuo Miyoshi; Hidetoshi Okada; Toshihiko Miyake; Hisashi Yokoyama; Yasuhiko Kato, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/381,162

(22) PCT Filed: May 6, 1998

(86) PCT No.: PCT/JP98/02016

§ 371 Date: Sep. 16, 1999

§ 102(e) Date: Sep. 16, 1999

(87) PCT Pub. No.: WO99/57428

PCT Pub. Date: Nov. 11, 1999

(51) Int. Cl.[7] ..... F02M 25/07
(52) U.S. Cl. ..... 123/568.23
(58) Field of Search ..... 123/568.11, 568.12, 123/568.21, 568.23, 568.24

(56) References Cited

U.S. PATENT DOCUMENTS

| | | | | |
|---|---|---|---|---|
| 4,163,282 | * | 7/1979 | Yamada et al. | 123/568.12 |
| 5,184,593 | * | 2/1993 | Kobayashi | 123/568.24 |
| 5,503,131 | * | 4/1996 | Ohuchi | 123/568.24 |
| 5,666,930 | * | 9/1997 | Elder | 123/568.12 |
| 5,701,874 | | 12/1997 | Sari et al. | 123/568.26 |
| 5,769,390 | | 6/1998 | Ando | 251/129.11 |
| 6,089,536 | * | 7/2000 | Watanabe et al. | 123/568.24 |

FOREIGN PATENT DOCUMENTS

| | | |
|---|---|---|
| 0 638 718 A1 | 2/1995 | (EP) . |
| 0 887 540 A2 | 12/1995 | (EP) . |
| 3-000385 | 1/1991 | (JP) . |
| 3-385 | 1/1991 | (JP) . |
| 7-091322 | 4/1995 | (JP) . |
| 7-91322 | 4/1995 | (JP) . |
| 8-014114 | 1/1996 | (JP) . |
| 8-319902 | 12/1996 | (JP) . |
| WO 99 47842 | 9/1999 | (WO) . |

* cited by examiner

*Primary Examiner*—Willis R. Wolfe
(74) *Attorney, Agent, or Firm*—Sughrue, Mion, Zinn, Macpeak & Seas, PLLC

(57) ABSTRACT

The present invention relates to a mounting device for an exhaust gas re-circulation valve which prevents the overheating, due to high temperature exhaust gas, of a stepping motor powering the opening and closing of the valve and the valve main body of an exhaust gas re-circulation valve which opens and closes the exhaust gas re-circulation passage of an engine. The valve body 201 of the exhaust gas re-circulation valve is buried in a component 100 of the engine having a lower temperature than the exhaust gas. In such a way, the high temperature of the exhaust gas may be absorbed, dispersed and radiated and as a result there is no need to provide a separate cooling structure such as a coolant chamber and the overheating of the stepping motor 300 due to high temperature exhaust gas may be prevented.

9 Claims, 4 Drawing Sheets

MOUNTING DEVICE FOR EXHAUST GAS RE-CIRCULATION VALVE

FIELD OF THE INVENTION

Figure 1:
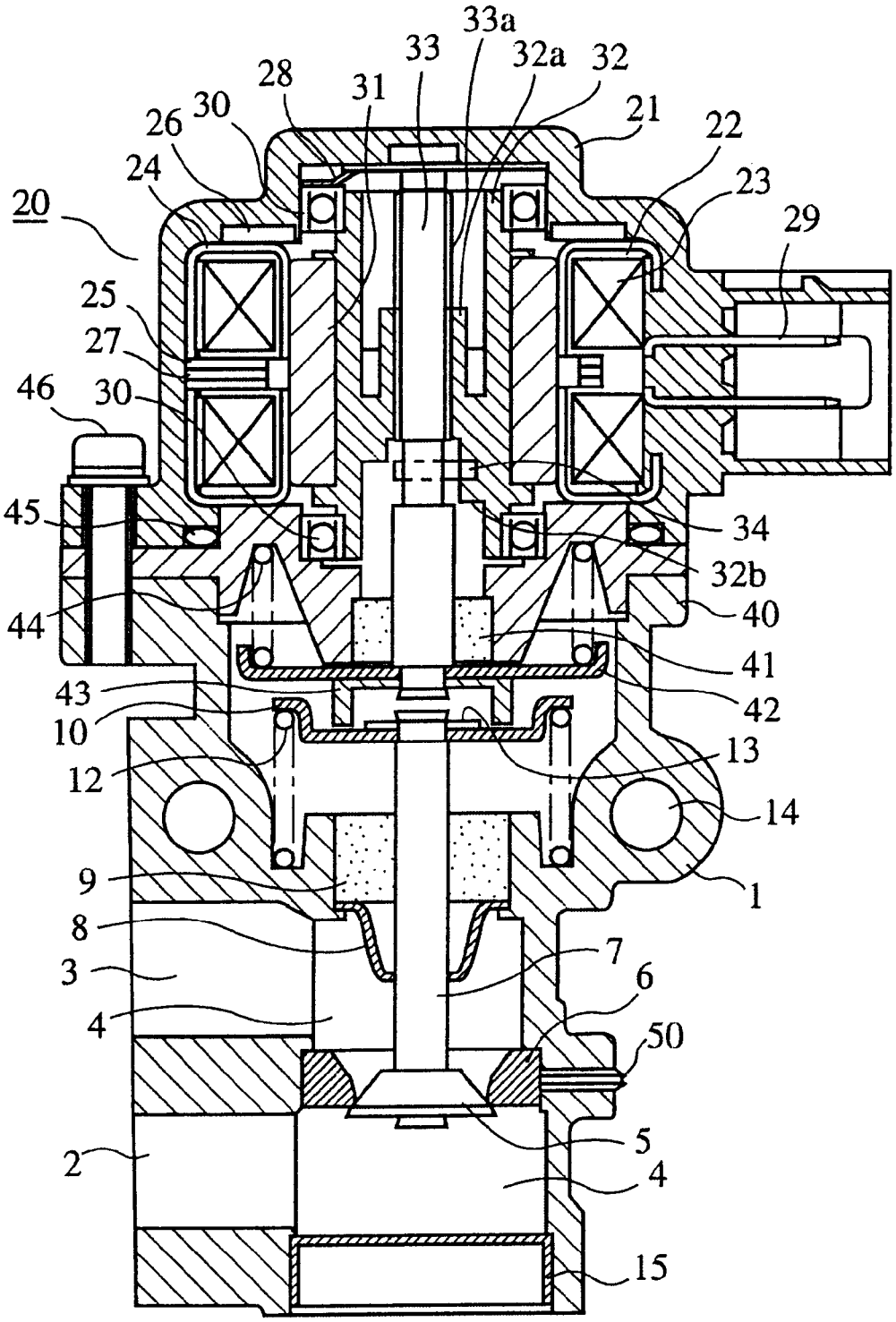
Figure 2:
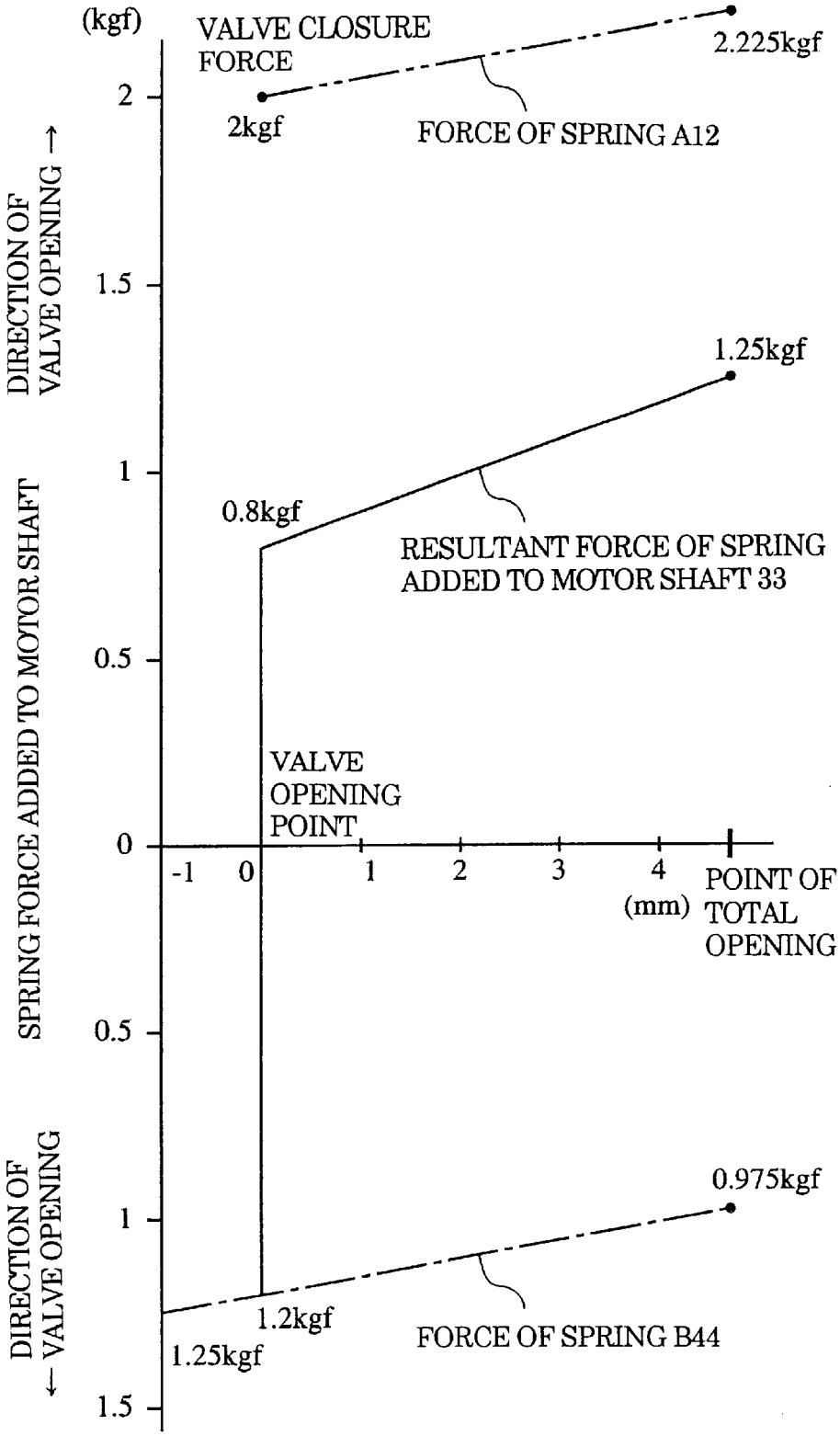
Figure 3:
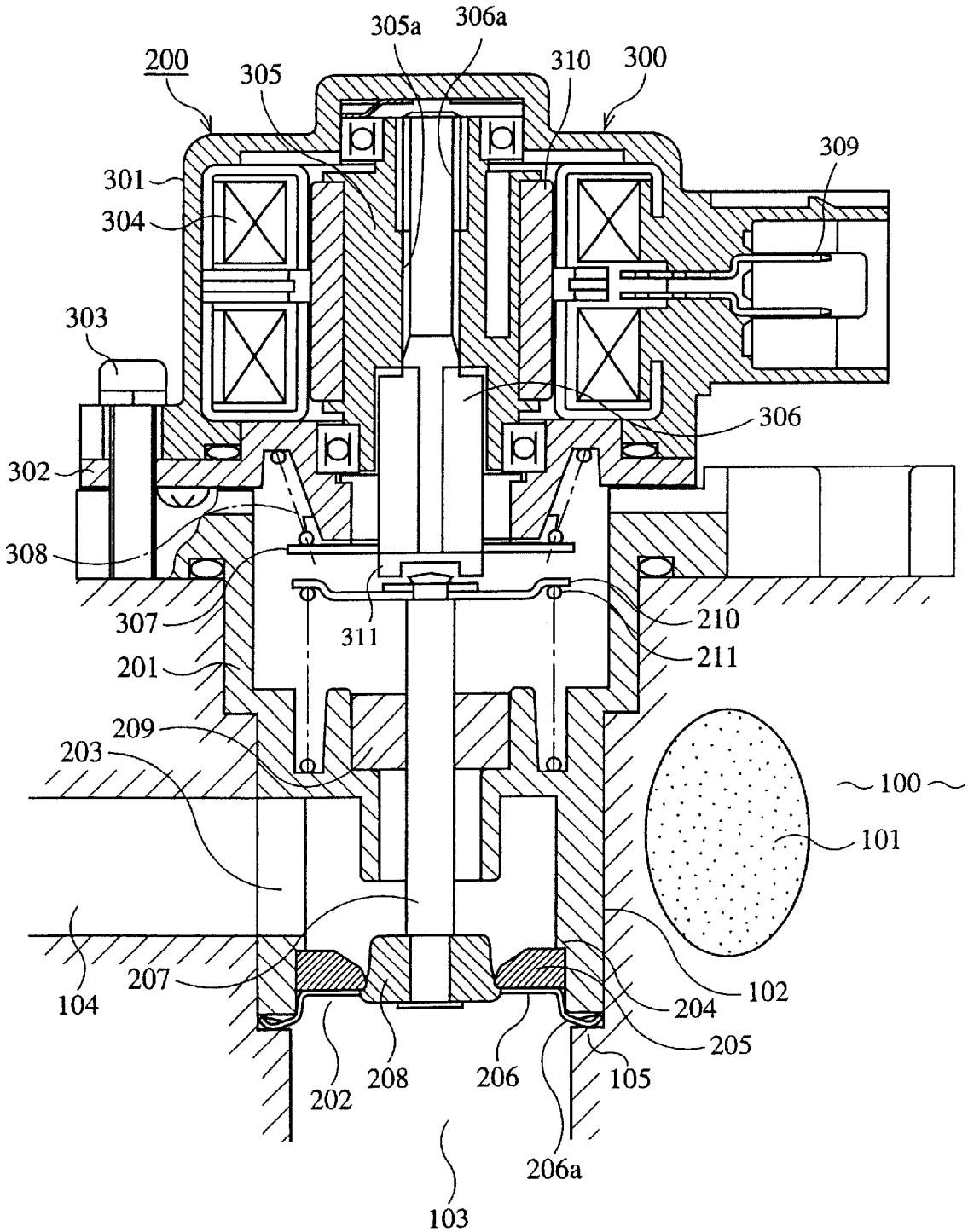

The present invention relates to a mounting device for an exhaust gas re-circulation valve provided in an exhaust gas recirculation pathway in an internal combustion engine.

BACKGROUND OF THE INVENTION

Diagram 1 is an internal layout diagram of a stepping motor driven exhaust gas re-circulation valve. The stepping motor is a device for controlling the valve by electrical motive force.

In the diagram, reference numeral 1 represents the housing (valve body), and comprises an inlet port 2 connected to the engine exhaust system (not shown), an outlet port 3 connected to the engine air intake system (not shown) and a re-circulation pathway 4. The valve seat 6 is press-fitted into the re-circulation pathway and prevents the rollpin 13 from detaching. 9 is a bush acting as a bearing, 8 is a holder for preventing the build up of deposits on the bush 9 and is fitted on the same axis as the valve seat 6 between the housing 1. 5 is a valve which is disposed in abutment with the valve seat 6 and is secured to the valve shaft 7 by caulking. The valve shaft 7 extends through the bush 9 and a spring holder 10 and washer 50 are fixed to its other end by caulking. 12 is a spring which is provided between the spring holder 10 and the housing 1 in a compressed state with the direction of force being in the direction of valve closure. 14 is a cooling passage for cooling the motor and the body of the valve.

20 is the body of the stepping motor and is mounted on the housing 1 by a mounting screw so that the axes correspond. 22 is a bobbin around which the coil 23 is entwined, and which is provided with a yoke 24 and yoke 25 providing a magnetic circuit around the outer circumference. 29 is a terminal which is electrically connected to the coil 23 and which forms the connector element with the motor housing 21. 27 is a plate which shields magnetically the two coil sections. 26 is a plate preventing the seepage of resin into the inner part of the coil when the motor housing is armor molded.

31 is a magnet. 32 is a rotor which protects the magnet 31 and forms a stopper 32*b* in the axial direction of the motor shaft and the threaded section 32*a* which meshes with the threaded section 33*a* of the motor shaft in the inner section. 30 are bearings fitted to both ends of the rotor 32. 28 is platespring which pressures the side of the bearing. 33 is a reciprocating motor shaft which converts the rotations of the rotor 32 to rectilinear motion by the threaded sections 32*a*, 33*a*. 34 is a stopper pin which is press fitted into the motor shaft 33, 41 is a motor bush which functions as a bearing for the motor shaft 33 and prevents rotation around the D hole.

40 is a motor holder disposed between the housing 1 so as to be concentric with the motor housing 21 and which protects the bearing 30 and the motor bush 41. The spring holder 42 and the joint 43 are fixed to the distal end of the motor shaft 33 by caulking. 44 is a spring which is compressed between the spring holder 42 and the motor holder 40 so that the direction of the force is in the direction of valve opening 5.

The operation of the valve will be explained on the basis of the force corresponding to the position of the valve in diagram 2.

With reference to diagrams 1 and 2, when the valves are opened starting from a position of total valve closure, the rotor 32, including the magnet 31, rotates in the direction of valve opening in a step-wise fashion in response to electrical pulses sent from the control unit (not shown) in the terminal 29. The number of steps correspond with the number of pulses and constitutes precise open loop control. The step-wise rotations are converted into rectilinear motion by the threaded section 32*a* of the rotor 32 and the threaded section 33*a* of the motor shaft 33. The motor shaft moves in the direction of valve opening (shown in the lower part of the diagram). At this stage, the movement of the motor shaft 33 is assisted by the force of the spring 44. At the moment when the joint 43 and the spring holder 10 are in abutment as a result of this motion, since the force of the springs is added, the necessary force to move the motor becomes the difference of the springs. Further movement entails increased load including the spring constant of the springs.

When the valves are closed, the above process is reversed. The rotor 32 including the magnet 31 rotates step-wise in the direction of valve closure in response to: electrical pulses sent from the control unit (not shown) in the terminal 29. At the moment when the joint 43 and the spring holder 10 become detached as the closure process continues, the load of the spring 44 is added to the motor shaft 33 and the load of the spring 12 is added to the valve 5 as a closure force.

A numerical example of the above process will now be discussed. If the setting of the spring is set using the open valve position as a standard, then the spring 12 in the set position has a load of 2 Kg f, and a spring constant of 0.05 Kg f/mm. The spring 44 in the set position has a load of 1.2 Kg f and a spring constant of 0.05 Kg f/mm. If the stroke from motor shaft activation to valve opening is given as 1 mm, and from opened to totally opened as 4.5 mm, then as shown in Diagram 2, the maximum load on the motor at point of activation and point of total opening is equal to 1.25 Kg f. In addition the force of closure of the valve is 2 Kg f and is equal to the load in the set position of the spring A12.

Now referring to the conventional organization of the device (without the spring 44), since the load condition of the spring 12 is the same, in order to achieve the same closure force as in the second diagram, the force generated by the motor must reach a maximum of 2.225 Kg f ( when the valve is completely opened).

As conventional exhaust gas re-circulation valves are constructed in the above manner, although it is possible to cool the valve body and the stepping motor with coolant introduced into the cooling passage 14, the valve body must be sufficiently large to form the cooling passage 14 around the housing 1. Furthermore a pipe is necessary to connect the coolant passage 14 to the engine coolant system which increases the number of necessary parts. The separate coolant system increases the complexity of the layout, all of which increases the price.

The present invention is proposed to solve the above problems. It is a purpose of the present invention to provide, without the need for a separate cooling system, a mounting device for an exhaust gas re-circulation valve which prevents overheating of the valve body and the stepping motor, which controls the movement of the exhaust gas re-circulation valve, due to high temperature exhaust gas. The invention also involves both a reduction in the size of the exhaust gas re-circulation valve and in the costs involved.

It is a further object of the present invention to enable easy mounting of the exhaust gas re-circulation valve on the engine block and to prevent the high temperature of the exhaust gas from being transmitted to the stepping motor.

Further objects include reductions in costs and the use of the invention in conjunction with a seal in the mounting part which prevents the valve seat from dislodging.

DISCLOSURE OF THE INVENTION

The mounting device for an exhaust gas re-circulation valve of the present invention comprises a valve body disposed in connection with the engine exhaust gas re-circulation passage, a valve seat provided in the interior of the valve body, a valve shaft mounted movably in the axial direction of said valve body, a valve which is connected to the valve shaft and which moves in the proximal abutting direction of the valve seat when said valve shaft moves in one direction and which moves away from said valve seat when said valve shaft moves in the other direction and a stepping motor which controls the direction of opening and closure of the valve through valve shaft. The valve body is buried in low temperature components of the engine such as the water outlet, intake manifold and throttle chamber.

By burying the valve body of the exhaust gas re-circulation valve in low temperature parts of the engine in accordance with the mounting device of the exhaust gas re-circulation valve, it is possible to absorb, diffuse and radiate the high temperature of the exhaust gas throughout the engine components. As a result, no separate cooling mechanism such as a coolant chamber is necessary and the components of the engine can prevent the overheating of the stepping motor due to high temperature exhaust gas.

The mounting device for an exhaust gas re-circulation valve of the present invention provides a valve mounting hole in the low temperature components of the engine, the hole enabling the insertion of the valve body.

The mounting device for an exhaust gas re-circulation valve of the present invention allows for the simple mounting of the exhaust gas re-circulation valve in the engine components by merely inserting the valve body of the exhaust gas re-circulation valve into the valve mounting hole located in the low temperature engine components.

The mounting device for an exhaust gas re-circulation valve of the present invention provides a valve mounting hole proximate to the cooling passage of the engine.

In accordance with the present invention, the engine components are cooled by the engine coolant flowing through engine cooling passage, therefore the placement of the valve body proximate to the cooling passage prevents the overheating of the valve body due to high temperature exhaust gas and, to that degree, the overheating of the stepping motor is also prevented. Furthermore the same advantage is obtained in areas of the engine without coolant such as the intake manifold due to the large volumes of intake air flowing through the body.

In the present invention, since the engine layout comprises an exhaust gas intake passage and an exhaust gas outlet passage connected to the exhaust gas re-circulation passage, it is possible to re-circulate the exhaust gas smoothly.

The mounting device for an exhaust gas re-circulation valve of the present invention provides a seal member on the edge of the aperture of the exhaust gas inlet of the valve body which acts both as a seal between the engine components and also prevents the valve seat from dislocating.

Hence by using a single seal member, it is possible to both prevent exhaust gas from escaping from between the valve body and the engine components and prevent the dislocation of the valve seat from the valve body.

SIMPLE EXPLANATION OF THE DIAGRAMS

Diagram 1 is a cross section showing a conventional exhaust gas recirculation valve.

Diagram 2 is an explanatory view showing the necessary motive force of the valve impelling motor.

Diagram 3 is a cross section showing the mounting device for the exhaust gas re-circulation valve according to embodiment 1 of the present invention.

Diagram 4 is an enlarged partial cross section of Diagram 3.

PREFERRED EMBODIMENTS OF THE INVENTION

The preferred embodiments of the invention will be explained below with reference to the accompanying drawings.

Embodiment 1

Figure 4:
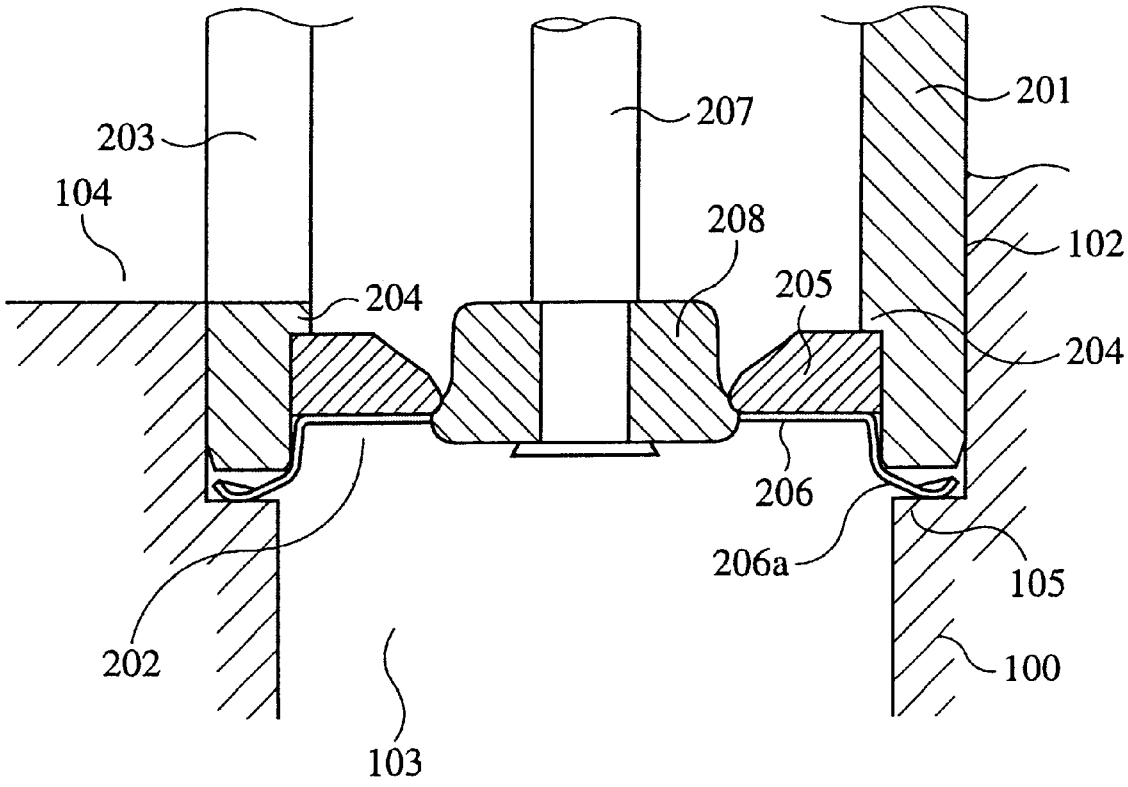

Diagram 3 is a cross section showing the mounting device for an exhaust gas re-circulation valve according to a first embodiment of the invention. FIG. 4 is an enlarged partial cross section of Diagram 3. In the diagrams, reference numeral 100 denotes components of the engine with a maximum temperature of 120° C. and lower in temperature than the exhaust gas. These components are hereinafter termed "the engine block" and include the sealing block for a water cooled engine, the water outlet for engine coolant, the intake manifold and the throttle chamber.

101 is a cooling passage such as an oil passage, water passage or air passage provided in the engine block 100 for cooling the engine. The cooling passage 101 is found in conventional engine blocks 100 of water cooled engines. 102 is a valve mounting hole provided proximally to the cooling passage 101 of the engine block 100. 103 is an exhaust gas intake passage provided in the engine block 100 and communicating with the valve mounting hole 102. The exhaust gas intake passage 103 is connected to the first side passage (exhaust gas passage)of the exhaust gas re-circulation passage. 104 is an exhaust gas outlet provided similarly in the engine block 100 and communicating with the valve mounting hole 102. The exhaust gas outlet 104 is connected to the second side passage (intake passage) of the exhaust gas re-circulation passage. 105 is a seal element provided in the communicating element of the valve mounting hole 102 and the exhaust gas re-circulation passage 103.

200 is an exhaust gas re-circulation valve mounted on the engine block 100. 201 is the valve body of the exhaust gas re-circulation valve 200. The valve body 201 is inserted into the valve mounting hole 102 of said engine block 100. 202 is the exhaust gas re-circulation inlet hole of the valve body 201. 203 is the exhaust gas re-circulation outlet hole of the valve body 201. 204 is a locking element for fixing the valve seat provided in the exhaust gas re-circulation inlet hole 202. 205 is a valve seat which is press fitted into said exhaust gas inlet hole 202 and is in abutment with the locking element 204. 206 is a seal member which is inserted into said exhaust gas inlet hole 202 and is in abutment with the lower surface of the valve seat 205 and pushes the valve seat 205 between the locking element 204. The seal member 206 is a flexible member composed of a material having rigidity such as stainless steel and has a skirt 206*a* bent on its outer peripheral edge.

The skirt 206*a* pushes against the seal 105 of the engine block 200 and due to its flexibility and acts as a seal on the bottom end of the valve body 201.

Therefore said seal member 206 functions as a seal preventing exhaust gas from escaping between the bottom end of the valve body 201 and the seal 105 of the engine block 100. It also functions as a valve seat securing member preventing the valve seat 205 from dislodging from the exhaust gas inlet hole 202 of the valve body 201.

207 is a valve shaft movably mounted in the axial direction of the valve body 201. 208 is a valve connected to the bottom of the valve shaft 207. 209 is a bearing of the valve shaft 207. 210 is a spring seat mounted at the top end of said valve shaft 207. 211 is a return spring impelling said valve shaft 207 via the spring seat 210 in the direction of closure of said valve 205.

300 is a stepping motor controlling the opening and closure of said valve 208 through said valve shaft 207. 301 is a motor housing for the stepping motor 300 and is fixed to the top end of the valve body 201 through the spacer 302 by a clamp screw 303. 304 is the coil of the stepping motor 300. 305 is the rotor of the stepping motor 300. 306 is the motor shaft of the stepping motor 300. The rotor 305 and the motor shaft 306 are hinged by a screw.

307 is a spring seat connected to the bottom of said motor shaft 306. 308 is an assisting spring interposed between the spring seat 307 and the spacer 302. The assisting spring 308 impels said motor shaft 306 in the direction of valve opening and assists in driving the motor.

The operation of the invention will now be explained.

Starting from a position in which the valve is totally closed, when the valve opening operation commences, the rotor 305, including the magnet 310, rotates step-wise in the direction of valve opening in response to electrical pulses sent from the control unit (not shown) in the terminal 309. The number of steps correspond to the number of transmitted pulses resulting in exact open loop control. The step-wise rotation is converted into rectilinear motion by the threaded section 305*a* of the rotor 305 and the threaded section 306*a* of the motor shaft 306. As a result, the motor shaft moves in the direction of valve opening (the downwards direction in the diagram). The motor shaft 306 is assisted in this motion by the force of the spring 308. As soon as the joint 311 and the spring holder 210 are in abutment, since the force of the spring 211 is added, the necessary force for moving the motor lies in the difference between both springs. Subsequent movement results in increased load to which is added the spring constant of both springs.

In such a way, when the valve 208 opens, the exhaust gas flowing into the exhaust gas re-circulation passage from the combustion chamber of the engine returns to the combustion chamber of the engine taking the following route: from the exhaust gas inlet passage 103 of the engine block 100 to the exhaust gas inlet 202 of the valve body 201 then into the valve body 201 then to the exhaust gas outlet 203 of the valve body 201 then to the exhaust gas outlet passage of the engine block 100.

Hence the flow of the exhaust gas through the engine block results in the absorption, dispersion and radiation of the high temperature exhaust gas into the engine block which is of a lower temperature than the exhaust gas. However as the engine block 100 is cooled by coolant flowing through the cooling passage 101, the high temperature of the exhaust gas is not transmitted from the valve body 201 to the stepping motor 300. Hence it is possible to prevent the overheating of the stepping motor 300 due to the high temperature exhaust gas.

Embodiment 1 as explained above prevents the overheating of the stepping motor 300 due to high temperature exhaust gas and obviates the need for a separate coolant structure such as the conventional coolant chamber. This is achieved by burying the valve body 201 in the engine block 100 which has a lower temperature than the exhaust gas and mounting the stepping motor 300 on the top of the valve body 201 which has the result of absorbing, dispersing and radiating the high temperature of the exhaust gas into the engine block 100.

Furthermore there is provided a valve mounting hole 102 near the cooling passage 101 of the engine block 100 and the valve body 201 is buried in the valve mounting hole 102. Mounting by burying the exhaust gas re-circulation valve in the engine block 100 is easily performed by simply inserting the valve body 201 in the valve mounting hole 102. The engine block 100 is cooled by the engine coolant flowing through the cooling passage 101. Since the valve body 201 is maintained in the environment of the coolant, the valve body 201 does not become overheated which in turn prevents the overheating of the stepping motor 300.

Furthermore, due to the fact that the skirt 206*a* of the seal member 206 pushes against the seal 105 of the engine block, the skirt 206*a* functions as a seal between the seal 105 of the engine block 100 and the lower border of the valve body 201. This not only prevents exhaust gas from escaping from between these two, but also prevents the detachment of the valve seat 205 as the seal member 206 is in abutment with the lower surface of the valve seat 205.

Industrial Application

As explained above, the exhaust gas re-circulation valve mounting device of the present invention provides for the burying of the valve body of the exhaust gas re-circulation valve in parts of the engine block having a lower temperature than the exhaust gas. It is possible to absorb, disperse and radiate the high temperature of the exhaust gas in the engine block without the need for a separate cooling structure such as a coolant chamber. As a result, it is possible to prevent the stepping motor from overheating due to the high temperature exhaust gas by using the engine block in such a way.

What is claimed is:

1. An exhaust gas re-circulation valve mounting device comprising:

a valve body operable to be inserted into an exhaust gas re-circulation passage of an engine to radiate high temperatures of the exhaust gas through engine components;

a valve seat provided inside said valve body;

a valve shaft mounted movably in an axial direction of said valve body;

a valve connected to said valve shaft and housed in said valve body, said valve moving in an abutting, proximal direction of said valve seat when said valve shaft moves in one direction and moving away from said valve seat when said valve shaft moves in the other direction; and a motor having a motor housing, a coil, a rotor, and a motor shaft controlling an opening and closing of said valve through said valve shaft, wherein said valve body of said exhaust gas re-circulation valve mounting device is buried in components of the engine which have a lower temperature than the exhaust gas, thereby eliminating a need for a separate cooling system in said exhaust gas re-circulation valve mounting device.

2. An exhaust gas re-circulation valve mounting device comprising:

a valve body operable to be inserted into an exhaust gas re-circulation passage of an engine to radiate high temperatures of the exhaust gas through engine components;

a valve seat provided inside the valve body;

a valve shaft mounted movably in an axial direction of said valve body;

a valve connected to said valve shaft and housed in said valve body, said valve moving in an abutting, proximal direction of said valve seat when said valve shaft moves in one direction and moving away from said valve seat when said valve shaft moves in the other direction; and a stepping motor controlling an opening and closing of said valve through said valve shaft, wherein said valve body of said exhaust gas re-circulation valve mounting device is buried in components of the engine which have a lower temperature than the exhaust gas, thereby eliminating a need for a separate cooling system in said exhaust gas re-circulation valve mounting device.

3. The exhaust gas re-circulation mounting device according to claim 2 wherein the engine component has an exhaust gas inlet and an exhaust gas outlet which are connected to the exhaust gas re-circulation passage.

4. The exhaust gas re-circulation mounting device according to claim 2 wherein a valve mounting hole is provided in an engine component and said valve body is insertedly buried in said valve mounting hole.

5. The exhaust gas re-circulation mounting device according to claim 4 wherein the valve mounting hole is provided in a proximate position to those engine components having a cooling passage.

6. The exhaust gas re-circulation mounting device according to claim 2 wherein a sealing member is mounted on the edge of the aperture of the exhaust gas inlet of the valve body, said sealing member sealing the engine components and preventing the detachment of the valve seat.

7. The exhaust gas re-circulation mounting device according to claim 6, wherein the seal member further comprises a skirt which pushes against a seal of an engine block providing a seal on a bottom end of said valve body.

8. The exhaust gas re-circulation mounting device according to claim 2, further comprising a first spring seat mounted on top of said valve shaft such that a return spring impels said valve shaft via said first spring seat.

9. The exhaust gas re-circulation mounting device according to claim 8, further comprising a motor shaft having a second spring seat connected to a bottom portion thereof such that an assisting spring impels said motor shaft via said second spring seat.

* * * * *